US008836534B2

(12) United States Patent
Field

(10) Patent No.: US 8,836,534 B2
(45) Date of Patent: Sep. 16, 2014

(54) METHOD AND SYSTEM FOR INTEGRATING SENSORS ON AN AUTONOMOUS MINING DRILLING RIG

(75) Inventor: Grant Andrew Field, Brisbane Qld. (AU)

(73) Assignee: Sandvik Intellectual Property AB, Sandviken (SE)

( * ) Notice: Subject to any disclaimer, the term of this patent is extended or adjusted under 35 U.S.C. 154(b) by 156 days.

(21) Appl. No.: 13/319,378

(22) PCT Filed: May 10, 2010

(86) PCT No.: PCT/US2010/034216

§ 371 (c)(1),
(2), (4) Date: Nov. 8, 2011

(87) PCT Pub. No.: WO2010/129944

PCT Pub. Date: Nov. 11, 2010

(65) Prior Publication Data

US 2012/0056751 A1 Mar. 8, 2012

Related U.S. Application Data

(60) Provisional application No. 61/176,653, filed on May 8, 2009.

(51) Int. Cl.

| | |
|---|---|
| ***G01V 3/00*** | (2006.01) |
| ***E21B 44/00*** | (2006.01) |
| ***E21B 7/02*** | (2006.01) |

(52) U.S. Cl.

CPC ..... *E21B 7/022* (2013.01); *E21B 44/00* (2013.01)

USPC ..... 340/853.2; 73/152.34

(58) Field of Classification Search

USPC ..... 340/854.1–854.9; 73/152.43, 152.46; 175/26

See application file for complete search history.

(56) References Cited

U.S. PATENT DOCUMENTS

| | | | | | |
|---|---|---|---|---|---|
| 4,285,236 | A | * | 8/1981 | Chien | 73/152.49 |
| 4,695,957 | A | * | 9/1987 | Peltier | 702/9 |
| 4,765,315 | A | * | 8/1988 | Krukowski | 601/32 |
| 4,914,591 | A | * | 4/1990 | Warren et al. | 702/9 |
| 5,548,397 | A | * | 8/1996 | Kool et al. | 356/141.1 |
| 5,687,137 | A | * | 11/1997 | Schmidt et al. | 367/131 |

(Continued)

OTHER PUBLICATIONS

International Search Report from PCT/US2010/034216 dated Jan. 18, 2011 (2 pages).

(Continued)

*Primary Examiner* — Hai Phan
*Assistant Examiner* — Royit Yu
(74) *Attorney, Agent, or Firm* — Osha Liang LLP

(57) ABSTRACT

An autonomous drilling rig (200), including a carriage including a mast (204), a rotary head (202) configured to traverse up and down the mast (204), and a wireless transmission system. The wireless transmission system includes a wireless transmitter (208) mounted on the rotary head (202) and configured to send a wireless signal to a wireless receiver (210). The wireless transmitter (210) includes a first connector (209) configured to engage with a first sensor, wherein the sensor measures at least one operating parameter. The wireless transmission system further includes the wireless receiver (210) configured to receive the wireless signal from the wireless transmitter (208), wherein the wireless signal comprises the at least one measured operating parameter, and a display unit (610) operatively connected to the wireless receiver (210) and configured to display the measured operating parameter.

33 Claims, 5 Drawing Sheets

(56) References Cited

U.S. PATENT DOCUMENTS

| | | | | |
|---|---|---|---|---|
| 6,006,844 | A * | 12/1999 | Van Puymbroeck et al. | 175/50 |
| 6,419,032 | B1 * | 7/2002 | Sullivan et al. | 175/40 |
| 7,143,845 | B2 * | 12/2006 | Leppanen | 175/162 |
| 8,006,783 | B2 * | 8/2011 | Rupp et al. | 175/57 |
| 8,245,792 | B2 * | 8/2012 | Trinh et al. | 175/40 |
| 8,474,550 | B2 * | 7/2013 | Byreddy et al. | 175/57 |
| 2002/0044838 | A1 * | 4/2002 | Amin et al. | 405/224.2 |
| 2002/0092701 | A1 * | 7/2002 | Norris et al. | 181/102 |
| 2005/0169717 | A1 * | 8/2005 | Field | 408/13 |
| 2006/0162962 | A1 * | 7/2006 | Koederitz et al. | 175/27 |
| 2006/0219438 | A1 | 10/2006 | Moore et al. | |
| 2008/0033653 | A1 * | 2/2008 | Pabon et al. | 702/6 |
| 2008/0066959 | A1 * | 3/2008 | Pastusek et al. | 175/39 |
| 2008/0142209 | A1 * | 6/2008 | Mello et al. | 166/53 |
| 2009/0058674 | A1 * | 3/2009 | Papouras et al. | 340/853.2 |
| 2009/0157318 | A1 * | 6/2009 | Woerpel et al. | 702/9 |
| 2010/0007871 | A1 * | 1/2010 | Blanco | 356/27 |

OTHER PUBLICATIONS

Written Opinion from PCT/US2010/034216 dated Jan. 18, 2011 (4 pages).

PCT Notification Concerning Transmittal of International Preliminary Report on Patentability and Written Opinion issued in PCT Application No. PCT/US2010/034216 mailed on Nov. 17, 2011 (6 pages).

Examiner's Report issued in corresponding Chilean Application No. 2795-2011 with English language letter reporting the same dated Mar. 14, 2013 (10 pages).

Office Action issued in corresponding Chinese Application No. 201080029707.5 with English translation dated Jan. 30, 2014 (47 pages).

Office Action issued in corresponding Chilean Application No. 2795-2011 with English reporting thereof dated Nov. 15, 2013 (10 pages).

* cited by examiner

METHOD AND SYSTEM FOR INTEGRATING SENSORS ON AN AUTONOMOUS MINING DRILLING RIG

FIELD OF THE DISCLOSURE

Embodiments disclosed herein relate generally to equipment used in the mining industry. Specifically, embodiments disclosed herein relate to equipment used in surface mining drilling.

BACKGROUND

Relatively large rotary drills may commonly be used in the mining industry for the drilling of holes in ore beds and strata. Large earth boring machines, commonly known as blast-hole drilling rigs may be used in a process which involves mapping out a drill pattern, drilling a blast hole, and filling the blast hole with explosives. An individual blast pattern may typically consist of 50 or more holes, each hole containing a measured quantity of explosives required to fracture the strata as intended.

FIG. 1 shows a typical blast-hole drilling rig (100), such as that described in U.S. Pat. No. 7,143,845. The drilling rig (100) includes a carriage (102), a mast (104) disposed on the carriage (102), and a rotary head (106) mounted on the mast (102), where the rotary head (106) rotates a drill string on which a drill bit is mounted. The rotary head may be raised up or lowered down the mast by, for example, a hydraulically driven feed system. The rotary head (106) includes a housing forming an internal chamber, a driving mechanism, and a rotation transmission mechanism disposed in the chamber, for rotating the drill pipe. The rotation transmission mechanism includes a gear system having a power input section operably connected to the motor, and a power output section adapted for connection to the drill pipe. The rotation transmission mechanism may include an anti-vibrational inertial body forming part of the power input section for storing rotational energy to even-out rotary speed variations and resist the generation of vibrations during operation. A cab (108) is typically attached to the carriage (102), and may include controls for operating the drill rig (e.g., programmable logic controllers, controller area network (CAN) based devices, etc.) for processing and displaying data obtained from sensors on the rotary head (106).

In addition, a blast-hole drilling rig (100) typically includes a tachometer (not shown) used to monitor the rotary speed of the drill pipe. A tachometer is an instrument capable of displaying revolutions per minute (RPMs). More specifically, the tachometer is located in the cab (108), and is wired to a pulse-pick up (PPU). The PPU, which is a type of sensor for measuring the RPMs of the drill pipe (not shown), is typically operatively connected to the rotary head (106) and measures the RPMs of a drill pipe that is drilled into the earth.

As the rotary head moves up and down the mast of the drill rig, the wiring between the pulse pick-up (PPU) and the tachometer located in the cab console must also travel with the rotary head. Thus, as the rotary head traverses the length of the mast, the wiring often fatigues through constant flexing and fails. Weather conditions also affect the failure rate of the wires. Increased longevity of the PPU wiring may be achieved by pulling the wiring through a hydraulic hose and anchoring this securely. However, even with this additional support, the wiring eventually fails due to fatigue. Due to the frequent failure of the wiring, drilling typically continues without such measurements, with the operator on the rig instead making visual observations about the RPM and rate of penetration.

However, as the industry moves toward autonomous (unmanned) drilling, there will be no human on board the drilling rig to observe drilling. Data wires for the radio tachometer would need to be more reliable because measurement and monitoring of such operating parameters are necessary for autonomous drilling control. Specifically, for autonomous drilling rigs, it is important that the automatic drilling control system be aware of all operating parameters such as how fast the drill pipe is turning.

What is needed is a more reliable and longer lasting method for transmission of data within a surface drill rig.

DETAILED DESCRIPTION

Figure 1:
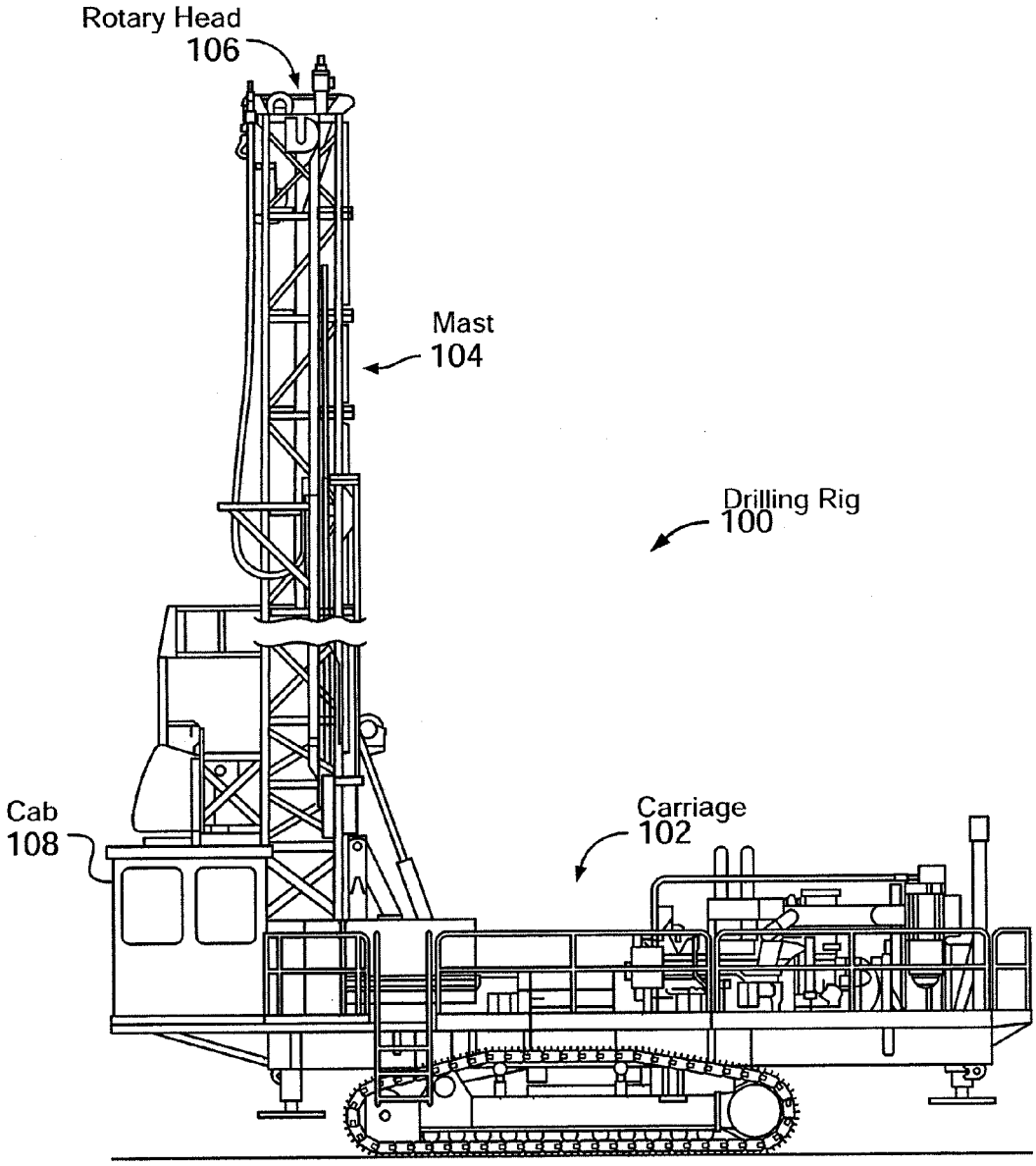
FIG. 1 (Prior Art)
FIG. 1 shows a prior art mining drill rig.

Specific embodiments of the invention will now be described in detail with reference to the accompanying figures. Like elements in the various figures are denoted by like reference numerals for consistency.

In the following detailed description of embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

In general, embodiments disclosed herein provide an apparatus to wirelessly transmit data collected on a mining drill rig. More specifically, embodiments of the present disclosure relate to a sensing and measuring instrument for use with a wireless transmission means (sending and receiving) to transmit and receive data collected by sensors located on the drilling rig.

Autonomous drilling, i.e., unmanned drilling rigs that are controlled remotely, refers to so-called teleoperated rock drilling apparatuses. Autonomous mining operations refers to the collective use of unmanned drilling rigs, loading vehicles and other mining vehicles, which can be controlled from an external, for example overground, control room using video cameras, for instance. Because of the lack of human involvement in autonomous drilling systems, data must be sensed and transmitted to a remote computing device where the data may be monitored, analyzed, and optimized to control and improve the autonomous drilling process. Thus, for example, autonomous drilling rigs may include navigation systems that guide the drilling rig, markings that aide a remote controller to determine a particular position of the unmanned drilling rig, collision avoidance capabilities, and several other features that allow the drilling rig to operate without a human on board.

In addition, unmanned drilling rigs need to be highly reliable to avoid human intervention and able to recover from a problem or failure, replace used parts, and perform general upkeep of the autonomous drilling system and all its components on a regular basis. Further, autonomous drilling rigs require inexpensive and efficient solutions to collect and transmit data to the remote operator. Such solutions require software to control the hardware components of the drilling rig. The software must be capable of guiding the drilling rig to perform blasthole drilling in routed locations, detecting failures of components and errors in navigation, logging/reporting activities of the drilling rig, etc.

Figure 2:
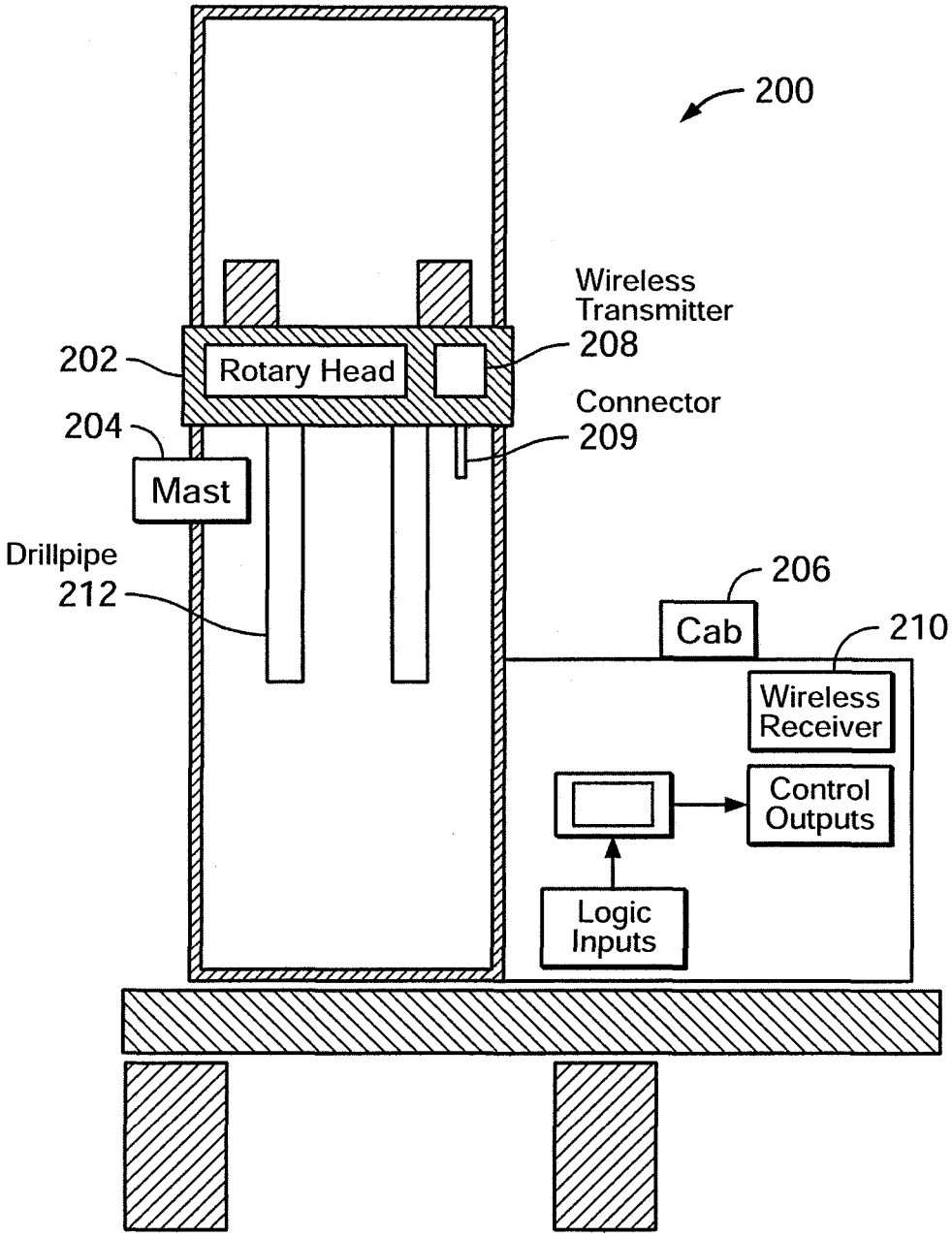
FIG. 2 shows a mining drill rig with a wireless transmission system in accordance with one or more embodiments disclosed herein.

FIG. 2 shows a mining drilling rig (200) that includes a wireless transmission system in accordance with one or more embodiments disclosed herein. The mining drilling rig (200) includes a mast (204), a rotary head (202), a cab (206), and the wireless transmission system. Specifically, the rotary head (202) shown in FIG. 2 has partially traversed the mast (204) and is positioned approximately in the middle of the mast (204). A drill pipe (212) is connected to the rotary head (202). The wireless transmission system on the mining drilling rig (200) includes a wireless transmitter (208), a connector (209), and a wireless receiver (210).

The wireless transmitter (208) may be any device capable of wirelessly transmitting data to the wireless receiver (210), such as those wireless transmitters known in the art. Specifically, the wireless transmitter (208) is responsible for generating an output signal with adequate signal strength to deliver a data/message. Further, the wireless transmitter may employ any wireless transmission means for delivering the data/message. For example, the wireless transmitter (208) may transmit data using radio frequency signals, ultrasonic signals, sonic signals, infrared signals, microwave signals, or any other suitable type of wireless transmission for data.

The wireless transmitter (208) includes a connector (209). The connector is configured to engage (i.e., mate) with a connector of a sensing instrument that senses and measures one or more operational parameters, such as revolutions per unit time, temperature, depth, vibration, torque, etc. When the connector (209) is engaged with a sensor connector, the wireless transmitter (208) obtains data measured by the sensing instrument. The sensing instrument may be, for example, a temperature sensor, a vibration sensor, a pulse pick-up (PPU) sensor that measures revolutions per minute of the drilling pipe, a laser sensor that measures, e.g., depth of the drilling pipe, or any other suitable type of sensing instrument that measures one or more operating parameters. Those skilled in the art will appreciate that the wireless transmitter may include capability to engage with multiple sensor connectors. For example, the wireless transmitter may includes multiple connectors or a universal connector configured to engage with various types of sensor connectors.

The wireless transmitter (208) is configured to transmit the measured data to the wireless receiver (210). Although not shown in FIG. 2, the wireless receiver (210) may be operatively connected to a display unit. Both the wireless receiver (210) and the display unit may be located in the cab (206). In one or more embodiments disclosed herein, the wireless receiver (210) is physically connected to the display unit, using wires. Alternatively, the wireless receiver may be wirelessly connected to the display unit, and may be in physical proximity to the display unit. The display unit may be any tool that allows the transmitted data to be monitored and/or displayed, so that action may be taken based on the measured data. For example, the display unit may be an output device associated with a computing device, such as a programmable logic controller or a graphical user interface, and/or a specific instrument configured to display a particular type of data, such as a tachometer for displaying revolutions per minute.

In one or more embodiments disclosed herein, the display unit may be monitored and controlled by a remote operator (or a remote site or remote rig) that operates a control system for the drilling rig. Thus, the data collected on the drilling rig and displayed on the display unit may be used to manipulate, control, and optimize drilling. More specifically, for example, in a scenario in which the drilling rig is an autonomous drilling rig, the remote operator may monitor the display unit to optimize autonomous drilling. The remote operator may be configured to view the display unit in the cab of the autonomous drilling rig using a video camera feed. Alternatively, the remote operator may remotely log into a computing device on which the display unit is executing. In this case, the remote operator may be able to change the display unit configuration remotely, and display more relevant information on the display unit than the default information that is displayed. In one or more embodiments disclosed herein, the wireless receiver (210) in the cab (206) may also include functionality to transmit data from the cab (206) to another receiver at a remote site. For example, the wireless receiver may be operatively connected to a transmitter with capability to transmit data to a second receiver located at a remote site. Thus, data may be transferred directly to a remote site, without being displayed on a display unit in the cab. In this scenario, directly transferred data may then be displayed for analysis and/or monitoring at the remote site.

Those skilled in the art will appreciate that although FIG. 2 shows the wireless transmitter (208) as mounted on or within the rotary head (202), the wireless transmitter (208) may be placed anywhere on the drilling rig that allows for the connector of the wireless transmitter (208) to engage with a sensor connector. Thus, for example, the wireless transmitter (208) may be mounted on the side of the mast (204), on the top of the rotary head (208), or in any other suitable position on the drilling rig, depending on the type of data being collected.

Further, those skilled in the art will appreciate that the wireless transmission system of FIG. 2 is not limited to surface mining drilling rigs or blast hole drilling. For example, the wireless transmission system may also be employed in underground drilling rigs, percussion drilling rigs, water well and/or exploration drilling rigs, which may not blast after drilling, but rather may drill a hole for access to something in the ground.

Radio Tachometer System

Figure 3:
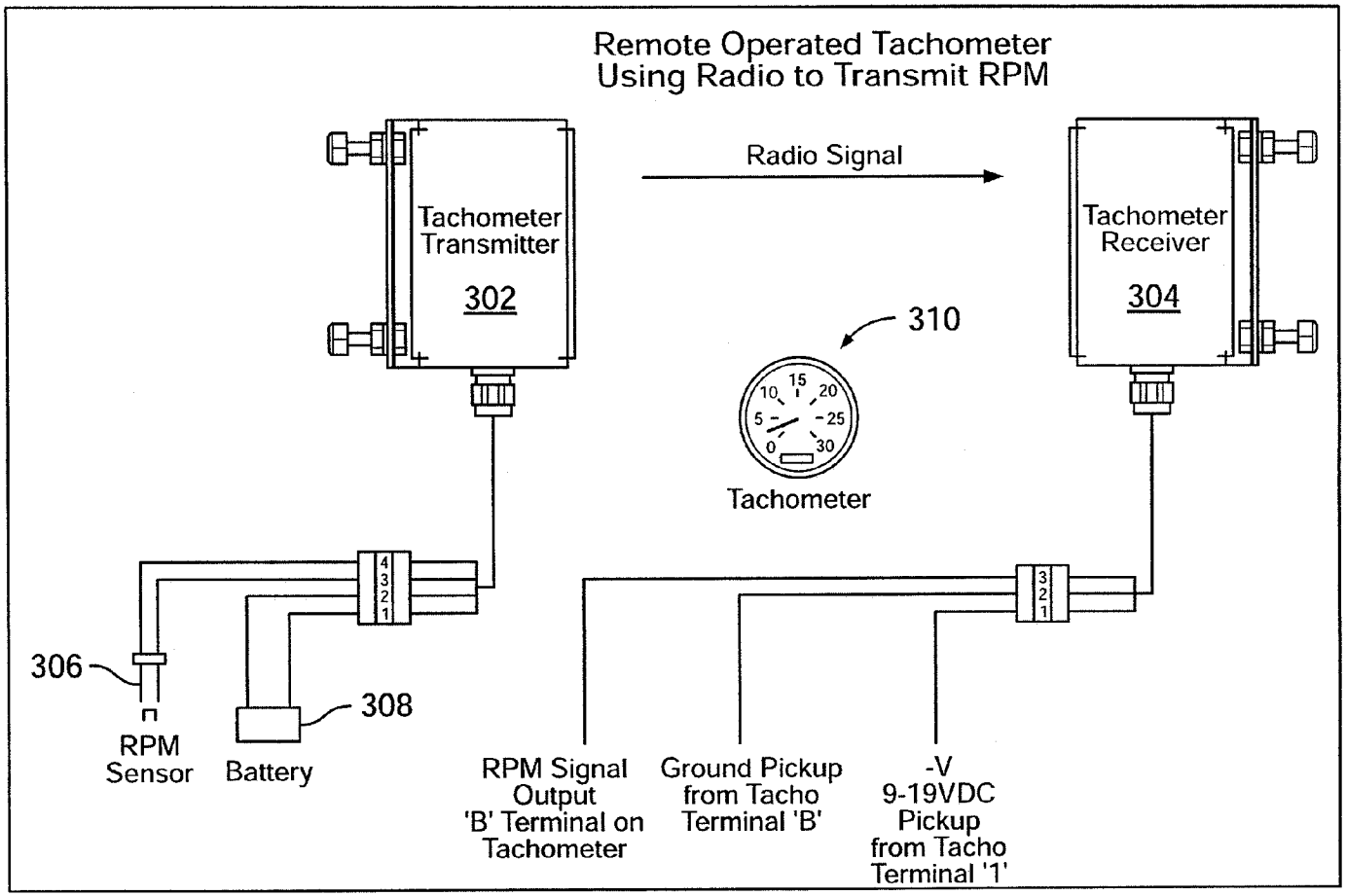
FIG. 3 shows a radio tachometer system in accordance with one or more embodiments disclosed herein.

An exemplary sensing and measuring instrument capable of wireless transmission of data in an autonomous mining drilling rig is a radio tachometer system that wirelessly transmits data using radio frequency signals. FIG. 3 shows a remotely operated radio tachometer system in accordance with one or more embodiments disclosed herein. Specifically, FIG. 3 shows a tachometer transmitter (302), a tachometer receiver (304), a connector (306), a battery (308), and a tachometer (310). Each of the aforementioned components of the radio tachometer system are described below.

In one or more embodiments disclosed herein, the tachometer transmitter (302) is a wireless transmitter (such as that shown in FIG. 2) that operates using radio frequency waves. Those skilled in the art would appreciate that any available communication protocol may be employed to facilitate the radio frequency transmission of data by the tachometer transmitter. The tachometer transmitter (302) includes a connector (306) that is configured to engage (i.e., mate) with a connector associated with a PPU sensor on the rotary head (not shown in FIG. 3). The tachometer transmitter (302) then obtains the RPM measurement from the PPU sensor (via the connection to the PPU sensor) and relays the data including the RPM measurements to the tachometer receiver (304) wirelessly. Those skilled in the art will appreciate that the tachometer transmitter (302) may obtain RPM measurements in a variety of ways, and that the present disclosure is not limited to connecting with a PPU sensor. For example, RPMs may be measured by inserting a turbine flow meter in the hydraulic system of the drilling rig, where the turbine flow meter is capable of measuring the amount of oil being supplied to the rotary head. From the amount of oil supplied to the rotary head, the RPMs of a drill pipe can be computed using known methods in the art. The tachometer transmitter (302) may be used, in this case, to wirelessly relay the measurement of the amount of oil supplied to the rotary head to the wireless receiver. Those skilled in the art will appreciate that the pulse pick-up sensor may entail an optical sensor, a mechanical sensor, a laser sensor, or any other suitable sensor.

In one or more embodiments, the tachometer transmitter is powered using a battery (308). The battery (308) may be a rechargeable battery. In this case, the battery charger may be located in the cab of the drilling rig, where a first battery is charged while a second battery is used to power the tachometer transmitter (302). In one or more embodiments, the tachometer transmitter (302) includes a sleep-mode for purposes of power saving. Those skilled in the art will appreciate that the tachometer transmitter may also be powered using alternative methods. For example, the tachometer transmitter may be powered using power harvesting methods that employ the hydraulic motor in the rotary head and/or other components of the drilling rig as a power source. Power harvesting is discussed in paragraph [0040] below.

The tachometer transmitter (302) is configured to transmit radio signals wirelessly to the tachometer receiver (304). The tachometer receiver (304) is configured to receive the radio signals from the tachometer transmitter (302). The tachometer receiver (304) may be located in the cab of the drilling rig, which facilitates machine powering of the tachometer receiver (304). Alternatively, the tachometer receiver (304) may be located outside of the cab or anywhere on the drilling rig. Typically, the tachometer receiver will typically receive data for rotary drilling up to 200 RPMs; however, it may also be greater than this range.

The tachometer receiver (304) is operatively connected to a standard tachometer (310). More specifically, the tachometer receiver (304) may include one or more connectors for physically connecting to a standard tachometer (310). Alternatively, the tachometer receiver (304) may be wired to the standard tachometer (310) The tachometer (310) is configured to display the RPMs of the drill pipe measured by the PPU sensor and relayed wirelessly from the tachometer transmitter (302) to the tachometer receiver (304). The standard tachometer (310) may be monitored remotely by a control system operator. The remote operator may use the revolutions per minute data displayed on the standard tachometer to control, manipulate, and/or optimize drilling. For example, a particular revolutions per minute value may be pre-determined as a goal for autonomous drilling, and when drilling conditions exist where it may be beneficial to decrease or increase RPMs, the remote operator or an automatic drilling control system may intervene in the autonomous drilling process to change input parameters on the drill rig.

The tachometer transmitter (302) and the tachometer receiver (304) may be configured for bi-directional communication. For example, the tachometer receiver (304) may contain a transmitter to transmit calibration data to the tachometer transmitter (304). Further, those skilled in the art will appreciate that while a single tachometer transmitter and a single tachometer receiver are shown in FIG. 3, there may be several alternative configurations of the radio tachometer system. For example, the radio tachometer system may include a single tachometer transmitter and multiple receivers, or several tachometer transmitters located in various positions on the drilling rig and a single tachometer receiver configured to receiver data wirelessly from each tachometer transmitter.

Those skilled in the art will appreciate that embodiments disclosed herein are not limited to a radio tachometer system for measuring RPM data. For example, embodiments disclosed herein may employ an ultrasonic tachometer system that uses ultrasonic signals to wirelessly transmit RPM measurements.

In addition, those skilled in the art will appreciate that a single wireless transmitter may be employed to wirelessly transmit different types of data, in addition to, or instead of RPM measurements. Thus, the tachometer transmitter may be a generic wireless transmitter that includes multiple connectors to connect to various types of sensors. Alternatively, the drilling rig may employ multiple wireless transmitters, one of which is a tachometer transmitter for transmitting RPM measurements, while other wireless transmitters are used to transmit temperature data, vibration data, torque, pressure, or any other suitable value. Regardless of how many wireless transmitters are employed, the basic set up for wireless transmission of data on an autonomous drilling rig would be similar. Specifically, a sensor is connected to a connector on the wireless transmitter, and the data obtained by the sensor is relayed to the wireless transmitter, and then to the corresponding wireless receiver. The type of sensor connected to the wireless transmitter may vary, depending on which operating parameter(s) are being measured.

Figure 4:
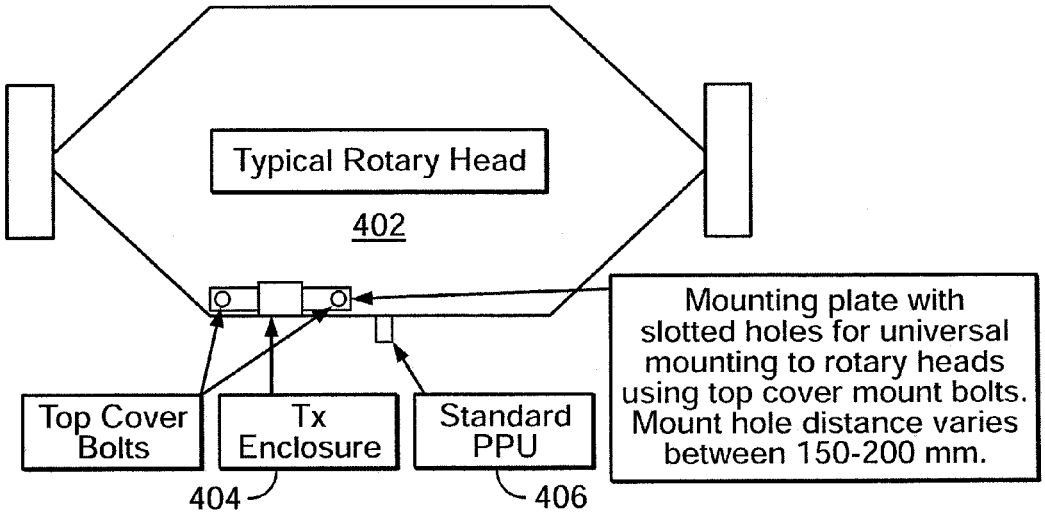
FIG. 4 shows an exemplary placement of a radio tachometer transmitter in accordance with one or more embodiments disclosed herein.

FIG. 4 shows a top view of the rotary head (402) and an exemplary placement of the tachometer transmitter in accordance with one or more embodiments disclosed herein. In FIG. 4, the tachometer transmitter is shown enclosed in a casing (404), which is described in detail in FIG. 5 below. The entire tachometer transmitter casing (404) may be mounted on the rotary head using any type of connector. For example, the tachometer transmitter casing may be mounted using top cover bolts, one or more types of adhesives, screws, welded mounts and/or any combination thereof.

Figure 5:
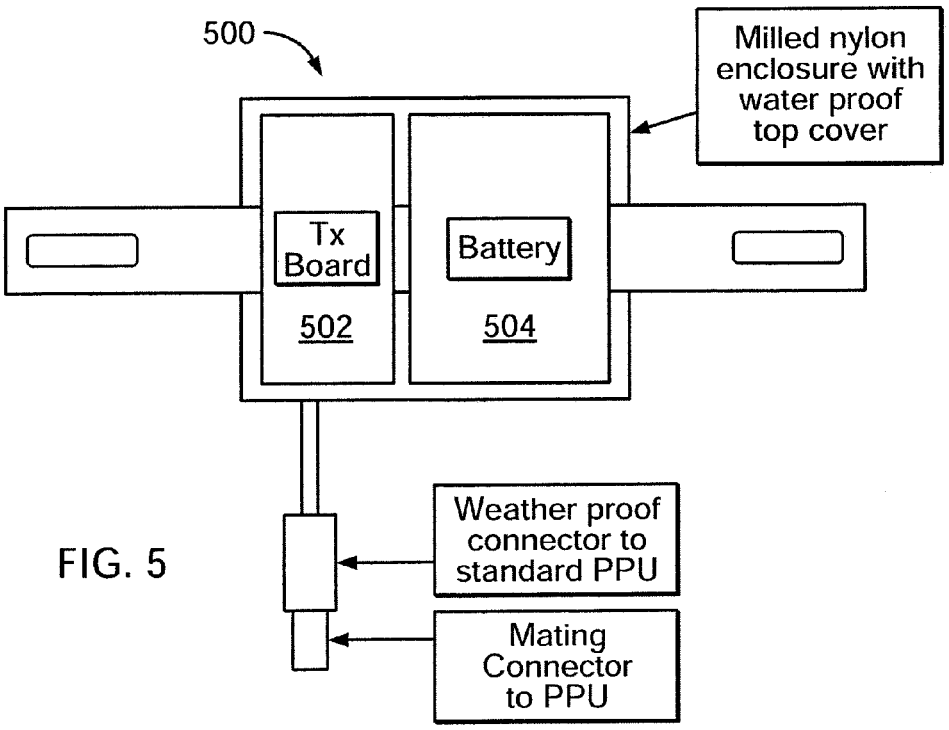
FIG. 5 shows a radio tachometer transmitter enclosure in accordance with one or more embodiments disclosed herein.

FIG. 5 shows an exemplary design for a tachometer transmitter casing (500). The tachometer transmitter casing (500) may be designed to protect the tachometer transmitter from weather conditions, wear due to traveling movement of the rotary head to which the transmitter is mounted, and other protective conditions. Thus, the casing (500) may be a hardened enclosure configured to house the transmitter board (502) and a battery (504). For example, the casing may be a milled nylon enclosure with a water proof top cover. In addition, the casing (500) facilitates simple and quick battery replacement along with quick access to the transmitter board (502) in the scenario in which field programming of the transmitter is required. The connector for connecting with the PPU sensor may also be weather proof.

Those skilled in the art will appreciate that the enclosure and mounting system of the tachometer transmitter may be universal, such that the tachometer transmitter can be fitted to any type of rotary head. Alternatively, the tachometer transmitter (or a generic wireless transmitter) may be mounted inside the rotary head, and may include an access panel on the outside of the rotary head to access the transmitter. Further, although not shown in FIG. 5, the tachometer receiver also has a receiver board associated with the tachometer receiver, which mounts behind the main console in the cab, which requires minimal protection. Both the transmitter and receiver boards may be designed to consume minimal power, have a range of approximately 25 meters, and minimal interference with other frequency bands.

Power Harvesting Techniques

In addition to, or instead of, using rechargeable batteries to supply power to the tachometer transmitter (or any wireless transmitter), embodiments of the present disclosure relate to harvesting power from the existing components of the drilling rig to eliminate the need to replace discharged batteries and/or replace the need for a battery powered tachometer transmitter. For example, the driving mechanism in the rotary head may be used to generate power for powering the tachometer transmitter. More specifically, a driving mechanism such as a hydraulic motor, or electrical motor on the rotary head may be used to power a generator. The powered generator may then supply power to the tachometer transmitter, which is located on the rotary head in one or more embodiments. In another embodiment of the disclosure, in which the driving mechanism is a hydraulic motor, a mechanical shaft on the hydraulic motor may be used to drive a generator to recharge the batteries in the tachometer transmitter. In addition, the generator may be used to recharge batteries located in the drilling head, which would eliminate the need for manual recharging or changing out of batteries by a remote operator monitoring, e.g., an autonomous drilling rig.

Alternatively, in one or more embodiments disclosed herein, power may be harvested using an intermittent power source. For example, the tachometer transmitter may intermittently connect to a power source, e.g., a battery recharger, located for example at the top of the mast, each time the rotary head travels to the top of the mast. Alternatively, the power source may be located anywhere in the traversal path of the rotary head, and the tachometer transmitter (or any wireless transmitter that is mounted on or within the rotary head) may briefly connect to obtain power each time the rotary head reaches the location of the power source on the mast. Those skilled in the art will appreciate that data collected by the tachometer transmitter may also be offloaded while the tachometer transmitter is connected to the intermittent power source. Thus, power may be obtained and data collected during the drilling process may be offloaded simultaneously.

Alternatively, power may be harvested using solar energy or other power sources that do not necessarily stem from the components of the drilling rig.

Drill String Sensing and Measuring

In mining drilling rigs, sensor information generated by tools and components contained within the drill string on the drill rig which do not necessarily travel downhole may be processed and displayed real-time. Such tools and components in the drill string located adjacent to or near the rotary head do not travel below the deck of the drill and are thus capable of staying within transmission range of a wireless transmission system at all times.

For example, in one or more embodiments disclosed herein, a vibration sub may be used to detect tri-axial vibrations directly below the rotary head. Sensor information measured by the vibration sub may be sent via a transmitter located on the vibration sub and received by a receiver that is part of the radio tachometer system. Sensor information from the vibration sub may alternatively be sent to a receiver located anywhere on the drill rig. In yet another embodiment, the vibration sub may have a direct hard-wired data link inside the annulus of the vibration sub to connect to the radio tachometer system and use the radio tachometer transmitter to send vibration data to a source in the cab or off the drill rig. In one or more embodiments, the vibration sub may also utilize power harvesting mechanisms to obtain power. For example, the vibration sub may harvest power from a slip ring arrangement designed to transmit power to the vibration sub via the rotary head.

Downhole Sensing and Measuring

In mining drilling rigs, which are mobile drilling rigs that are placed, for example, on a moving tract, sensor information generated from tools and components obtained downhole on the drilling rig can be processed and displayed semi real-time. This is due to the fact that mining involves drilling several holes in a short period of time and then, for example, blasting the drilled holes with explosives. Thus, drill pipes are inserted and then pulled out of the earth very quickly. As a result, surface and downhole measurements may be relayed semi real-time. This is due to the fact that mining involves blast hole drilling, which is the drilling of production benches would typically be 50 or more holes with the majority being in the range of 10 to 70 meters. Thus, each hole is drilled relatively quickly (as compared to oil and gas drilling systems) and information is obtained almost immediately (e.g., in under 60 minutes for each single blast hole) after a hole is drilled.

For example, formation logging information after drilling the hole could be relayed to the mine geology function for use to plan the blasting operation that is done subsequent to the drilling of the entire pattern. By obtaining such information in semi-real time, the mine geologists may obtain a head-start. For sensor information such as vibrations, such information may be used as input into an automated drilling control logic for planning how to drill the next series of holes. Thus, some of the information collected that involves downhole measurements may be obtained semi real-time. The wireless transmission of the sensed and measured data in accordance with embodiments disclosed herein further facilitates the semi real-time processing and analysis of the data collected with autonomous mining drilling rigs.

Embodiments of the disclosure also relate to using a wireless transmission system to relay data collected from drill string tools and components in the drill string. For example, a vibration sensor sub placed in the drill string may measure the vibrations within the drill string. Other sensors placed in tools and components in the drill string (that may or may not enter the borehole) and used downhole may be a torque sensor, a pressure sensor, a temperature sensor, and/or a magnetometer used to measure magnetic fields downhole. For example, a torque or vibration sensor sub may be located immediately below the rotary head and may not enter the borehole, and may remain in constant communication with the wireless transmitter (i.e., transmitting data real-time). In this case, the sensors located immediately below the rotary head may have their own wireless transmission means or may be electrically coupled to the same wireless transmitter used in the radio tachometer system. Such a sensor may also be configured for bi-directional communication. In addition, logging of data may occur during drilling, i.e., formation logging. For example, logging of data may involve ultrasonic and sonic logging, gamma logging, and resistivity logging. In formation logging, sensors or tools capable of logging may be in the drill bit and/or the drill pipe and/or in a sub.

In one or more embodiments disclosed herein, when the drill pipe is pulled out of the earth, the logged data may also be relayed using the wireless transmission system described above. In one or more embodiments, separate receivers (i.e., other than the receiver that receives surface data) may be configured to receive the data measured downhole. For downhole measurements, the location of the wireless transmitter may be different from other sensing and measuring systems, such as the radio tachometer system. For example, for downhole sensing, a wireless transmitter may be located on a sub behind the bit at the end of the drill pipe. In this case, as the bit is pulled out of the drilled hole, the transmitter becomes within range of the wireless receiver, and may transmit the data collected. Thus, depending on what type of measurements are being taken, the location of the wireless transmitter and time frame related to when the data is wirelessly transmitted, may vary.

Further, in one or more embodiments disclosed herein, downhole sensing using a wireless transmission system may also include bi-directional communication such that calibration data or any other suitable type of data may initially be transmitted to the wireless transmitter located in the drill pipe or immediately below the rotary head. This data may be used to calibrate or configure one or more components for downhole sensing. Subsequently, data collected during downhole operations may also be transmitted as described above, resulting in bi-directional communication. In addition, bi-directional communication may also be used to configure components/tools between drilled holes. For example, when a downhole tool containing a sensor or program logic is pulled out from the earth after drilling a first hole, bi-directional transmission may be useful to transmit data to change the sensor or program logic settings for drilling of a next hole. Thus, drilling may be optimized for each hole drilled by using the bi-directional communication of the wireless transmitter (s) and receiver(s).

In one such embodiment, a gamma sub is placed just above the bit at the end of the drill string. The gamma sub is used to characterize the formation and contains a battery pack to power the gamma sub. In order to prevent unnecessary drain on the batteries, bi-lateral communication from a transmitter, for example located on the rotary head, may transmit a signal to the gamma sub as the gamma sub is pulled from downhole and becomes within communication range with the transmitter, to go into sleep mode. The signal would instruct the gamma sub to remain in sleep mode until such time that the gamma sub is reactivated in the drilling of the blast hole pattern. This would extend the operating cycle of the gamma tool through conservation of battery power.

In another such embodiment, a downhole torque sub is placed just above the bit at the end of the drill string. The torque sub contains a sensor that measures the rotational torque just above the bit. The torque sub may also be configured with a means to allow some rotational slip to prevent damage to the bit cutting structure at a pre-set torque limit as detected by the sensor. Such a downhole torque sub may employ a viscous-clutched coupling to activate the rotational slip. The pre-set torque limit detected by the sensor may be re-set upon being retracted from downhole through bi-directional communication from a transmitter, for example, located on the rotary head. More specifically, the re-set of the torque limit may be performed to optimize the drilling in softer formations where damage is less likely at a higher torque re-set value.

Laser Depth Counter

Figure 6:
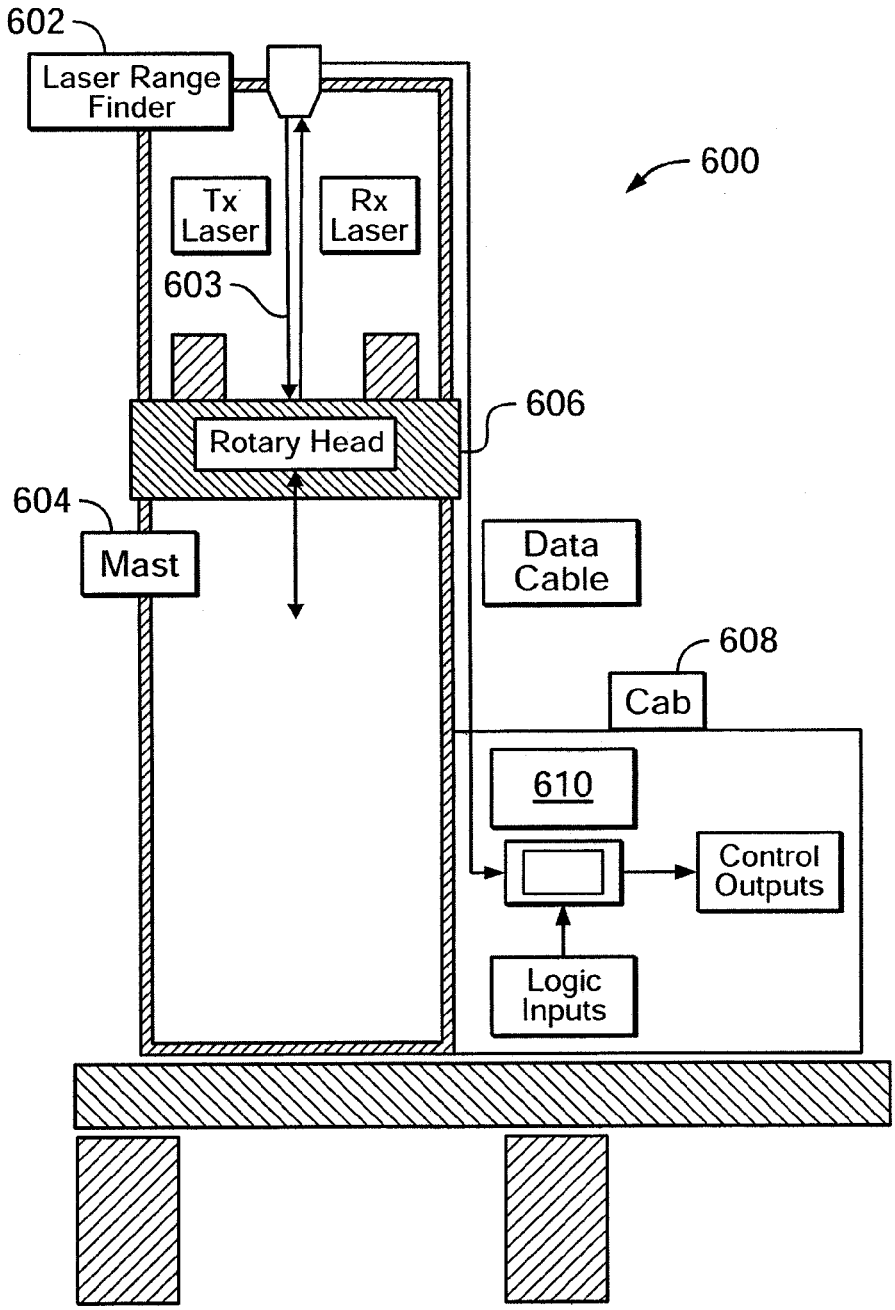
FIG. 6 shows a laser depth counter in accordance with one or more embodiments disclosed herein.

As described above, any type of sensor or sending and measuring instrument may employ the functionality of the wireless transmission system described in FIG. 2 above on an autonomous drilling rig. FIG. 6 shows a laser depth counter in accordance with one or more embodiments disclosed herein. The laser depth counter (600) is one example of a sensing a measuring instrument/tool that may employ a wireless transmission system on an autonomous drilling rig, and it is not meant to limit the scope of the invention.

Specifically, FIG. 6 shows an autonomous drilling rig that includes a laser depth counter (600), a mast (604), a rotary head (606), a cab (608), and a display unit (610). Each of the aforementioned components of the laser depth counter is described below. In one or more embodiments disclosed herein, the laser depth counter (600) is configured to take measurements that can be used to calculate the depth of the drill pipe.

The laser depth counter (600) includes a laser range finder (602) that employs a laser (603). The laser (603) uses a laser beam to determine the distance to a reflective object (e.g., the rotary head). The laser range finder (602) may operate on a "time of flight" principle by sending a laser pulse in a narrow beam towards an object, and measuring the time taken by the pulse to be reflected off the target and returned to the sender. The measurement of time obtained is then used to calculate the displacement of the object. As the rotary head (606) travels up and down the mast (604), the laser (603), aimed down at the rotary head (606) and fixed at the top of the mast (604), measures the displacement of the rotary head (606). The range of distances between the laser (603) mounted at the top of the mast (604) and the distance to the rotary head (606) as it traverses the mast (604) is the raw data collected by the laser range finder (602). This raw data may be relayed using a wireless transmission system on the drilling rig and subsequently used to compute the depth of the drilled hole as well as the penetration rates of the drill over time using methods known in the art.

More specifically, as discussed above, a wireless transmitter (not shown) may be operatively connected to the laser range finder (602). The location of the wireless transmitter in an autonomous drilling rig that employs a laser depth counter may be different from the location shown with respect to the radio tachometer system. For example, for laser depth counter measurements, the wireless transmitter may be located on a side of the mast, on top of the mast along with the laser range finder, or in any other suitable position on the drilling rig. To engage with the laser range finder (602), the wireless transmitter may include a connector configured to mate with a connector on the laser range finder. The displacement ranges measured by the laser range finder (602) may be obtained by the wireless transmitter and transmitted to the wireless receiver of the wireless transmission system.

Those skilled in the art will appreciate that the raw data generated by the laser range finder may be processed using commonly known methods, e.g., the data may be filtered using known filtering means. The raw data may be averaged or otherwise processed to increase accuracy or raw data validity.

Further, those skilled in the art will appreciate that while the laser is shown as being positioned at the top of the mast, embodiments of the invention are not limited to this location of the laser range finder. For example, in alternative embodiments, the laser range finder may be positioned at the bottom of the mast, in which case the laser range finder may be aimed up at the rotary head. In addition, the laser range finder may be positioned on the rotary head itself, on a side of the mast, in the cab (in which case trigonometric functions would be used to compute the range of distances of the rotary head) or in any other suitable location on the autonomous drilling rig. If the laser depth counter is set up to wirelessly transmit the displacement data, it may be beneficial to position the laser range finder on the rotary head so that the laser depth counter may share components of the wireless transmission system, such as the wireless transmitter and the power supply.

Continuing with FIG. 6, the wireless receiver may be operatively connected to a display unit (610), housed in the cab (608), such as a computing device or a programmable logic controller with an output display. The display unit is configured to display the data measured by the laser range finder and transmitted by the wireless transmitter. In addition, the depth display unit may be manipulated by an operator to show/display various operating parameters useful in exacting autonomous drilling rigs.

In scenarios in which the laser depth counter is used for downhole sensing, both the laser depth counter and the scanning device may relay data to a wireless transmission system employed on the autonomous drilling rig. Multiple wireless transmitters and receivers may be employed for this purpose. For example, a first wireless transmitter may be connected via a connector to the scanning device, while a second wireless transmitter may be connected to the laser range finder. Both the first and second wireless transmitters may transmit data to a single wireless receiver in the cab. Alternatively, there may be multiple wireless receivers, each connected to the display unit.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

The disclosures in the U.S. provisional patent application No. 61/176,653 from which this application claims priority, are incorporated herein by reference.

The invention claimed is:

1. An autonomous drilling rig, comprising:

a carriage comprising a mast;

a rotary head configured to traverse up and down the mast; and a wireless transmission system, comprising: a wireless transmitter mounted on the rotary head and configured to send a wireless signal to a wireless receiver wherein the wireless transmitter comprises a first connector configured to engage with a first sensor, wherein the sensor measures at least one operating parameter;

the wireless receiver configured to receive the wireless signal from the wireless transmitter, wherein the wireless signal comprises the at least one measured operating parameter; and a display unit operatively connected to the wireless receiver and configured to display the measured operating parameter.

2. The autonomous drilling rig according to claim 1, wherein the wireless receiver is located in a cab of the drilling rig.

3. The autonomous drilling rig according to claim 2, wherein the wireless receiver comprises functionality to transmit from the drilling rig to a second receiver located at a remote site.

4. The autonomous drilling rig according to claim 1, wherein the wireless transmission system is a radio frequency transmission system.

5. The autonomous drilling rig according to claim 1, wherein the wireless transmission system is an ultrasonic transmission system.

6. The autonomous drilling rig of claim 1, wherein the wireless transmitter comprises a second connector configured to engage with a second sensor.

7. The autonomous drilling rig of claim 6, wherein the first sensor measures revolutions per unit of time of a drill pipe operatively connected to the rotary head and wherein the second sensor measures vibrations of the drill pipe.

8. The autonomous drilling rig of claim 1, wherein the first sensor is a laser depth counter configured to measure a displacement of the rotary head.

9. An autonomous drilling rig, comprising:

a carriage comprising a mast;

a rotary head configured to traverse up and down the mast; and a radio tachometer system, comprising:

a tachometer transmitter configured to travel with the rotary head and configured to send a wireless radio signal to a tachometer receiver, wherein the tachometer transmitter comprises a connector configured to engage with a pulse pick-up (PPU) sensor, wherein the PPU sensor measures revolutions per unit time of a drill pipe;

the tachometer receiver configured to receive the wireless signal from the tachometer transmitter, wherein the wireless signal comprises the measured revolutions per minute of the drill pipe; and a tachometer operatively connected to the receiver and configured to display the measured revolutions per minute.

10. A radio tachometer system in an autonomous mining drilling rig, comprising:

a tachometer transmitter configured to send a wireless radio signal to a tachometer receiver, wherein the wireless signal comprises measured revolutions per minute of a drill pipe;

the tachometer receiver configured to receive the wireless signal from the tachometer transmitter; and a tachometer operatively connected to the tachometer receiver and configured to display the measured revolutions per minute; and wherein the tachometer transmitter comprises a connector configured to engage with a pulse pick-up (PPU) sensor on a rotary head of the autonomous drilling rig, wherein the PPU sensor measures the revolutions per minute of the drill pipe.

11. The radio tachometer system of claim 10, wherein the revolutions per minute of the drill pipe is measured optically using an optical sensor mounted on a mast of the autonomous mining drilling rig.

12. The radio tachometer system of claim 10, wherein the tachometer transmitter is battery operated, wherein at least one battery is rechargeable.

13. The radio tachometer system of claim 12, wherein a battery recharger is located in a cab of the drill rig.

14. The radio tachometer system of claim 12, wherein the battery recharger is an intermittent power source located on the mast.

15. The radio tachometer system of claim 12, wherein the tachometer transmitter is enclosed in a solid casing, and wherein the solid casing comprises a transmission board configured to house the tachometer transmitter and the at least one battery.

16. The radio tachometer system of claim 15, wherein the solid casing comprising the tachometer transmitter is mounted on a rotary head of a drill rig.

17. The radio tachometer system of claim 10, wherein the radio tachometer transmitter is powered by a hydraulically driven generator that obtains power from a hydraulic motor associated with the rotary head.

18. The radio tachometer system of claim 10, wherein the radio tachometer transmitter is powered by a mechanically driven generator that obtains power from a mechanical shaft on a hydraulic motor associated with the rotary head.

19. The radio tachometer system of claim 10, a generator powered by a driving mechanism on the drilling rig is configured to recharge the battery of the radio tachometer transmitter.

20. A method for using a radio tachometer system employed in an autonomous drilling rig, comprising:

obtaining, by a radio tachometer transmitter, data measured by a sensor configured to measure revolutions per minute of a drill pipe, wherein the radio tachometer transmitter is operatively connected to the sensor and located on a rotary head of the autonomous drilling rig;

wirelessly transmitting the measured revolutions per minute to a radio tachometer receiver; and displaying the sensor data on a tachometer for analysis by a remote operator.

21. The method of claim 20, wherein the radio tachometer transmitter is powered by one selected from a group consisting of a rechargeable battery and a hydraulically driven generator that obtains power from a hydraulic motor associated with the rotary head.

22. The method of claims 20, wherein power is generated from an intermittent power source mounted on a location on the mast, wherein the rotary head connects to the intermittent power source each time the rotary head travels to the location on the mast.

23. The method of claim 22, wherein data collected by the radio tachometer transmitter is offloaded while the rotary head is connected to the intermittent power source.

24. A drilling rig, comprising:

a carriage comprising a mast;

a rotary head configured to traverse up and down the mast, wherein the rotary head is powered using hydraulic energy; and a radio tachometer system, comprising: a tachometer transmitter configured to travel with the rotary head and configured to send a wireless radio signal to a tachometer receiver, wherein the tachometer transmitter comprises a connector configured to engage with a pulse pick-up (PPU) sensor, wherein the PPU sensor measures revolutions per unit time of a drill pipe;

the tachometer receiver configured to receive the wireless signal from the tachometer transmitter, wherein the wireless signal comprises the measured revolutions per unit time of the drill pipe; and a tachometer operatively connected to the tachometer receiver and configured to display the measured revolutions per unit time.

25. The drilling rig of claim 24, wherein the hydraulic energy is used to recharge a battery configured to power the tachometer transmitter.

26. A drilling rig, comprising:

a carriage comprising a mast;

a rotary head configured to traverse up and down the mast; and a radio tachometer system, comprising:

a tachometer transmitter configured to travel with the rotary head and configured to send a wireless radio signal to a tachometer receiver, wherein the tachometer transmitter comprises a connector configured to engage with a sensor configured to measure an operating parameter of the drilling rig;

the tachometer receiver configured to:

receive the wireless signal from the tachometer transmitter, wherein the wireless signal comprises the measured operating parameter, and transmit the measured operating parameter to a remote site, wherein the measured operating parameter is displayed on a display unit located at the remote site or used as input into a control system configured to optimize drilling by the drilling rig.

27. A mining drilling rig, comprising:

a carriage comprising a mast;

a rotary head configured to traverse up and down the mast; and a unit mounted to or traveling with the rotary head that contains a wireless radio tachometer system comprising a tachometer transmitter and a tachometer receiver configured to communicate using a wireless radio frequency signal, wherein the unit is configured to self-power using power harvesting, wherein power harvesting is performed using hydraulic energy to one of directly power the tachometer transmitter or to re-charge a battery configured to power the unit.

28. A method for using a wireless transmitter system employed in a mining drilling rig to collect data during a drilling process, comprising:

inserting a drill string operatively connected to a rotary head downhole, wherein the drill string comprises at least one component comprising a sensor for measuring data downhole and a wireless transmitter operatively connected to the sensor, wherein a wireless transmitter and a sensor mounted on the rotary head;

collecting data, by the wireless transmitter, measured by the at least one sensor during the drilling process;

withdrawing the drill string from downhole; and wirelessly transmitting the collected data from the rotary head to a wireless receiver, upon withdrawal of the drill string.

29. The method of claim 28, wherein the wireless transmission system is capable of bi-directional communication, and wherein the wireless transmitter receives calibration data from the wireless receiver.

30. The method of claim 28, wherein the at least one component is a vibration sub.

31. The method of claim 28, wherein the wireless transmitter obtains power using power harvesting from a driving mechanism that drives the rotary head.

32. A mining drilling rig, comprising:

a carriage comprising a mast;

a rotary head configured to traverse up and down the mast;

a wireless transmission system, comprising:

a wireless transmitter mounted on the rotary head and configured to transmit a wireless signal to a wireless receiver, wherein the wireless transmitter comprises a first connector configured to engage with a first sensor, wherein the first sensor is located directly beneath the rotary head and is configured to measure at least one operating parameter;

the wireless receiver configured to receive the wireless signal from the wireless transmitter, wherein the wireless signal comprises the at least one measured operating parameter, wherein the at least one operating parameter is displayed for analysis on a display unit operatively connected to the wireless receiver, wherein the first sensor remains constantly within a range of transmission of the wireless transmission system while drilling using the mining drilling rig.

33. A mining drilling rig, comprising:

a carriage comprising a mast;

a rotary head configured to traverse up and down the mast;

a wireless transmission system, comprising:

a wireless transmitter mounted on the rotary head and configured to transmit a wireless signal to a wireless receiver, wherein the wireless transmitter comprises a first connector configured to engage with a first sensor, wherein the sensor measures at least one operating parameter; the wireless receiver configured to receive the wireless signal from the wireless transmitter, wherein the wireless signal comprises the at least one measured operating parameter, wherein the at least one operating parameter is displayed for analysis on a display unit operatively connected to the wireless receiver; and a drill string comprising a component capable of being one of altered, reconfigured, or re-set as a result of a bilateral communication using the transmitted wireless signal.

* * * * *